US012404620B2

(12) United States Patent
Torres et al.

(10) Patent No.: US 12,404,620 B2
(45) Date of Patent: Sep. 2, 2025

(54) METHOD OF OPERATING A WASHING MACHINE AND WASHING MACHINE

(71) Applicant: E.G.O. Elektro-Geraetebau GmbH, Oberderdingen (DE)

(72) Inventors: Toni Torres, Llicà de Vall (ES); Jordi Camps, Llicà de Vall (ES); Pau Sala Perez, L'Escala (ES); Alvar Villegas, Llicà de Vall (ES); Gerard Sanchez, Llicà de Vall (ES); Uwe Schaumann, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 136 days.

(21) Appl. No.: 18/526,063

(22) Filed: Dec. 1, 2023

(65) Prior Publication Data

US 2024/0183097 A1 Jun. 6, 2024

(30) Foreign Application Priority Data

Dec. 5, 2022 (EP) ..... 22383183

(51) Int. Cl.

| | |
|---|---|
| ***D06F 34/10*** | (2020.01) |
| ***D06F 34/18*** | (2020.01) |
| *D06F 103/46* | (2020.01) |

(52) U.S. Cl.

CPC ..... *D06F 34/10* (2020.02); *D06F 34/18* (2020.02); *D06F 2103/46* (2020.02)

(58) Field of Classification Search

CPC ..... D06F 34/10

See application file for complete search history.

(56) References Cited

U.S. PATENT DOCUMENTS

| | | | |
|---|---|---|---|
| 2005/0015890 | A1 | 1/2005 | Kim et al. |
| 2019/0112745 | A1 | 4/2019 | Chai |
| 2019/0390392 | A1 | 12/2019 | Lee et al. |
| 2020/0048813 | A1 | 2/2020 | Schaumann et al. |

FOREIGN PATENT DOCUMENTS

| | | | |
|---|---|---|---|
| EP | 1561851 | A1 | 8/2005 |
| EP | 3608466 | A1 | 2/2020 |
| JP | 2005319075 | A | 11/2005 |

OTHER PUBLICATIONS

European Patent Office, Extended European Search Report received for Application No. 22383183.5, dated Jun. 2, 2023, 10 pages, Germany.

*Primary Examiner* — Jason Y Ko

(74) *Attorney, Agent, or Firm* — ALSTON & BIRD LLP

(57) ABSTRACT

In a method of operating a washing machine, different values for the power required by a drive motor of a drum of the washing machine to accelerate the drum from 30 rpm to 80 rpm are measured and stored as reference values. They can be differentiated by weight or load of laundry, potentially also by different types of laundry. These values are then compared to values derived from an actual washing or dry-spinning process, respectively. As a result of this comparison, it can be determined which values actually measured correspond sufficiently to stored values, and then the load can be determined from this result.

10 Claims, 6 Drawing Sheets

| 1 Towel | | | | | | | | | |
|---|---|---|---|---|---|---|---|---|---|
| | Power Min | | | Power Max | | | Power Average | | |
| | Min | Max | Avg | Min | Max | Avg | Min | Max | Avg |
| Pre-profile | 7,60 | 22,30 | 15,96 | 67,60 | 111,20 | 86,64 | 38,00 | 49,20 | 44,03 |
| Avg 3 trials | 10,43 | 21,73 | 15,91 | 67,60 | 97,70 | 82,18 | 35,87 | 39,17 | 37,64 |

| 1 Jean | | | | | | | | | |
|---|---|---|---|---|---|---|---|---|---|
| | Power Min | | | Power Max | | | Power Average | | |
| | Min | Max | Avg | Min | Max | Avg | Min | Max | Avg |
| Pre-profile | 4,80 | 10,40 | 7,24 | 42,10 | 64,90 | 56,44 | 22,00 | 27,90 | 24,57 |
| Avg 3 trials | 4,70 | 10,73 | 7,54 | 37,90 | 47,37 | 42,11 | 17,90 | 19,50 | 18,80 |

| QL Load | | | | | | | | | |
|---|---|---|---|---|---|---|---|---|---|
| | Power Min | | | Power Max | | | Power Average | | |
| | Min | Max | Avg | Min | Max | Avg | Min | Max | Avg |
| Pre-profile | 23,50 | 48,20 | 32,78 | 70,30 | 102,80 | 86,52 | 52,50 | 57,20 | 54,60 |
| Avg 3 trials | 15,80 | 31,53 | 26,15 | 58,10 | 71,97 | 67,55 | 40,30 | 46,20 | 43,30 |

FIG. 6

| | Power min | Power Max | Power Avg |
|---|---|---|---|
| QL Load | 32 | 93 | 60 |
| 1 Towel Limit | 17 | 77 | 44 |
| 1 Jean Limit | 7 | 42 | 23 |

FIG. 7

METHOD OF OPERATING A WASHING MACHINE AND WASHING MACHINE

CROSS-REFERENCE TO RELATED APPLICATIONS

This application claims priority to European Application No. 22383183.5, filed Dec. 5, 2022, the contents of which are hereby incorporated herein in its entirety by reference.

FIELD OF APPLICATION AND PRIOR ART

The invention relates to a method of operating a washing machine as well as to such a washing machine, wherein the washing machine has a washing machine control being adapted and designed to operate the washing machine with such a method.

It is known from US 2020/0048813 A1 to detect and recognize the movement of pieces of laundry in a rotating drum in a washing machine. This is possible by monitoring the current through the drive motor of the drum. This information is used to calculate a load of laundry in the drum, potentially even the kind of main fibre of the pieces of laundry.

Problem and Solution

It is an object of the invention to provide a method of operating a washing machine as well as to provide a washing machine adapted to apply this method, with which method and washing machine problems of the prior art can be solved and, in particular, it is possible to realize an advantages way of detecting whether a small quantity or a large quantity of laundry is in the drum.

This problem is solved by a method of operating a washing machine according to claim 1 and also by a washing machine according to claim 10. Advantageous and preferred embodiments of the invention are the subject-matter of the further claims and will be explained in more detail below. In so doing, some of the features will be explained only for the method or only for the washing machine. However, in respective of this, they can both be applied both to the method and also to the washing machine on their own and independently of one another. The wording of the claims is incorporated into the description by express reference.

The washing machine of the invention comprises a rotatable drum for holding laundry, a receiving container for receiving the drum therein, a drive motor for the drum and a power supply or a power control unit for controlling the drive motor and for supplying it with power. It also comprises a washing machine control being connected to the power supply and being designed to monitor and measure or evaluate, together with the power supply, a current curve when the drive motor is driven with power. Preferably, the washing machine control has a storage added to it or integrated into it. Furthermore, the washing machine has a control The method has the following steps. The drum is rotated at a first low rotational speed, preferably being between 10 rpm and 50 rpm, for example 30 rpm. A current through the drive motor and a rotational speed of the drive motor are monitored and measured or evaluated. For monitoring the current the power supply or the power control unit can be used, alternatively a current sensor. The rotational speed can be monitored by a rotation position sensor, preferably as an incremental encoder. The rotational speed of the drum is increased from the first low rotational speed to a second high rotational speed. This second high rotational speed is between 55 rpm and 150 rpm, for example 80 rpm. The current curve during the increase of the rotational speed from the first low rotational speed to the second high rotational speed is monitored and values are measured for a current minimum, a current maximum and an average current, wherein average values are being determined therefrom. This can be made by simple mathematical operations known to the skilled person. The determined average values for the current minimum, the current maximum and the average current are compared with memory values for the current minimum, the current maximum and the average current. Such memory values are stored in the washing machine control in a table, wherein these memory values are stored in the table with a division into at least three groups. A first group is a small quantity of laundry defined as less than 15% of a nominal load weight of laundry in the drum, for example less than 1 kg. A second group is a large quantity defined as more than 40% of a nominal load weight of laundry in the drum, for example more than 3 kg. A third group is a quantity of laundry in the drum, which quantity lies between the small quantity and the large quantity. It could also be regarded as a medium quantity.

In the comparison of the average values with the memory values, the greatest possible concordance is determined in each case between the values for at least two values or for even all three values. Following this, the group corresponding to these memory values with the highest concordance having the corresponding quantity of laundry is defined as being present in the drum. This can be made either by taking the greatest concordance or by defining that all values must match with the stored memory values. The information about the quantity of laundry present in the drum can be used for a further subsequent washing or dry-spinning process, also for dosing detergents or the like, adjusting a duration of various phases of the washing process or the like. A user thus needs not enter the information about the quantity of laundry to be washed or processed.

Any change in the rotational speed of the drum means a change in the kinetic energy of the system of drum and laundry combined. The more weight this combined system has, the more kinetic energy must be provided by the drive motor. If only a relatively small quantity of laundry is inside drum, the required energy or momentary power of the drive motor to speed up the drum from the first low rotational speed to the second high rotational speed is significantly less than in a case where a relatively large quantity of laundry is inside drum. This difference in the required energy or power, respectively, provided by the drive motor can be detected and can particularly be used in detecting whether there is small amount of laundry in the drum or a large one.

In an embodiment of the invention, the first low rotational speed may be chosen between 25 rpm and 35 rpm.

In a further embodiment of the invention, the second high rotational may be chosen between 75 rpm and 85 rpm. Both rotational speeds are quite different from each other, but these values should not vary when performing the method.

In another embodiment of the invention, a certain group with quantity of laundry, may it be a small or a large one, in the drum is considered to be recognized only if all three average values for the current minimum, the current maximum and the average current fit to the same group or correspond to the memory values of this group. This serves to avoid any wrong finding of the quantity of laundry in the drum, but can of course also make a definite finding much more difficult. So if no small quantity can be definitely detected, the following process will take place as for a regular quantity.

In a further embodiment of the invention, a previous step is performed in which it is determined by monitoring the current through the drive motor whether there is a small quantity defined as less than 15% of a nominal load weight of laundry in the drum or whether there is a large quantity defined as more than 40% of a nominal load weight of laundry in the drum. In case a large quantity of laundry has been detected, subsequently a different operation for treating the laundry is carried out than for a small quantity. This may relate to different parameters selected from rotational speed, water supply, detergent supply, or the like.

It is also possible to increase the rotational speed from the first low rotational speed to the second high rotational speed for three times, which gives a quite good basis for generating average values. So the average values for current minimum, current maximum and average current can be determined therefrom in total, which is a quite good approach.

In an embodiment of the invention, a distinction can be made in the table stored in the washing machine control not only according to the quantity of laundry, but additionally also according to the type of laundry present in the drum or its main fibre content, respectively. Different memory values for minimum current, maximum current and average current can also be stored for this purpose for each group. The quantity of laundry and the type of laundry in the drum can then be determined by comparison of the average values for minimum current, maximum current and average current. This comparison can be made similar as mentioned before.

The washing machine control of the washing machine is advantageously adapted and designed to operate the washing machine with the method as described before. So, no additional control or microprocessor is needed.

These and further features are evident not only from the claims but also from the description and the drawings, the individual features each being implemented by themselves or in multiples in the form of subcombinations for an embodiment of the invention and in different fields and being able to be advantageous and independent protectable embodiments for which protection is claimed here. The division of the application into individual sections and subheadings does not limit the general validity of the statements made thereunder.

BRIEF DESCRIPTION OF THE DRAWINGS

Exemplary embodiments of the invention are schematically illustrated in the drawings and will be explained in more detail below. In the drawings show FIG. 1 a schematic front view onto a washing machine according to the invention with pieces of laundry in it, FIG. 2 a schematic drawing of the forces acting on one piece of laundry in the drum of the washing machine of FIG. 1, FIG. 3 an advantageous algorithm for performing the invention, FIG. 4 another algorithm for performing the invention.

DETAILED DESCRIPTION OF THE EMBODIMENTS

Figure 1:
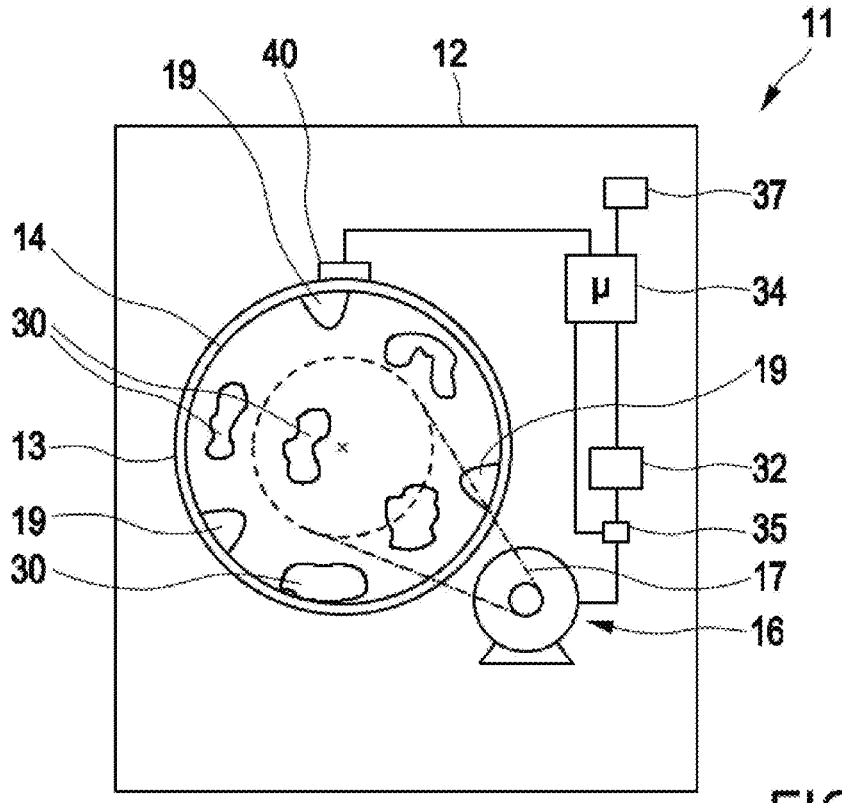

From FIG. 1 a schematic drawing of a washing machine 11 according to the invention can be taken. Washing machine 11 has a housing 12 with a rotating drum 14 in it being placed in a fix drum receptacle 13 surrounding it. Drum 14 is rotated or driven, respectively, by a drive motor 16 with drive belt 17 as is common in the art. On the inside of drum 14, three protrusions 19 are provided in rib-like form or in the form of a triangle with a rounded tip pointing inside the drum 14. The protrusions 19 are shown in profile and can preferably have this form in a direction parallel to the rotation axis of drum 14. The protrusions 19 are advantageous for the regular washing process, but are not absolutely necessary for the invention at hand.

Inside drum 14, several pieces of laundry 30 are shown being rotated and thrown about. This will be described in detail later. It corresponds to a normal process of rotating the drum with relatively low speed.

Drive motor 16 is driven or energized by power control unit 32, which again is controlled by washing machine control 34, preferably being the main control of the whole washing machine 11. Washing machine control 34 is connected to a current sensor 35, which is able to exactly supervise the drive current supplied to drive motor 16 by the power control unit 32. Such a current sensor 35 is known in the art and can be provided by the person skilled in the art without any problem. It may also be integrated into the power control unit 32 or into the drive motor 16 itself.

Integrated into drive motor 16 may be a rotation position sensor means for supervising or detecting a rotation position of the drum, which is not shown here due to the integration. Such a rotation position sensor means can be integrated into the drive motor 16 as is also common in the art, preferably as an incremental encoder. The rotation position sensor means is also connected to the central washing machine control 34. Washing machine control 34 is also provided with a storage 37 as mentioned before and will be explained in detail hereinafter, preferably being integrated into one semi-conductor component.

Figure 2:
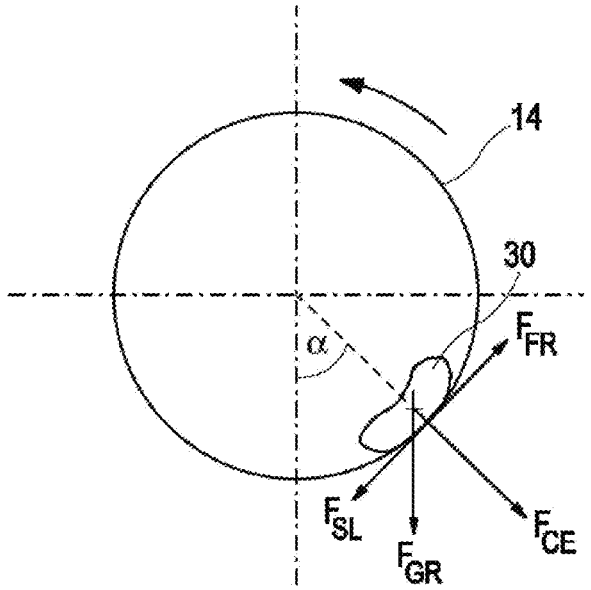

In FIG. 2, for better basic understanding of the invention, drum 14 is shown with a piece of laundry 30 in it. In reality, of course a plurality of pieces of laundry will be in the drum 14. A center of gravity or mass of the piece of laundry 30 is at an angle $\alpha$ to the vertical axis as indicated by the dashed line. Laundry 30 is abutted against the inside of drum 14 due to rotation of the drum 14. The force of gravity FGR is pointing vertically downwards. The centrifugal force FCE generated by the rotation of the drum 14 and depending on its rotation speed is pointing outwards in radial direction away from a center of drum 14 and through the center of gravity of the laundry 30. A frictional force FFR is pointing upwards from the region of contact of laundry 30 with the inside of drum 14 in a circumferential direction or in tangential direction, respectively, which is also at right angle to the centrifugal force FCE. A sliding force FSL is pointing in the opposite direction of the frictional force FFR. The laundry 30 is moved counterclockwise with rotating drum 14 by the frictional force FFR, if it does not abut against a protrusion 19. The sliding force FSL is pulling the laundry 30 downward again initiated by the gravity force FGR. When the fabric or the fibers of laundry 30 have a small friction coefficient and/or laundry 30 is lightweight, possibly because it does not take up much water, then there is not enough frictional force FFR. In consequence laundry 30 is simply sliding down on the inside of drum 14, most probably also over a protrusion 19. If a certain rotational speed is exceeded, the laundry 30 will be pressed by the centrifugal force FCE against the inside of the drum 14 and will not move relative to the drum 14 but rotate with it and with exactly the same rotational speed.

In a state when the laundry 30 is pressed against the drum 14 and thus rotates exactly together with the drum 14, any change in the rotational speed of the drum means a change in the kinetic energy of the system of drum 14 and laundry 30 combined. The more weight this combined system has, the more kinetic energy must be provided by the drive motor 16. If only a relatively small quantity of laundry 30 is inside drum 14, the required energy or momentary power of the drive motor 16 to speed up the drum from the first low rotational speed to the second high rotational speed is significantly less than when a relatively large quantity of laundry 30 is inside drum 14. This difference in the required energy or power, respectively, from the drive motor 16 can be detected and can particularly be stored in the storage 37 connected to the washing machine control 34. If now in practice, the washing machine 11 is loaded with an unknown quantity of laundry, this serves according to the invention to detect the power or energy requirement needed for this higher rotational speed and can be compared with memory values for the power or energy stored in the storage 37. In the invention, it is provided that these values are not stored directly in relation to power or energy, but to current minimum, current maximum and average current.

Figure 3:
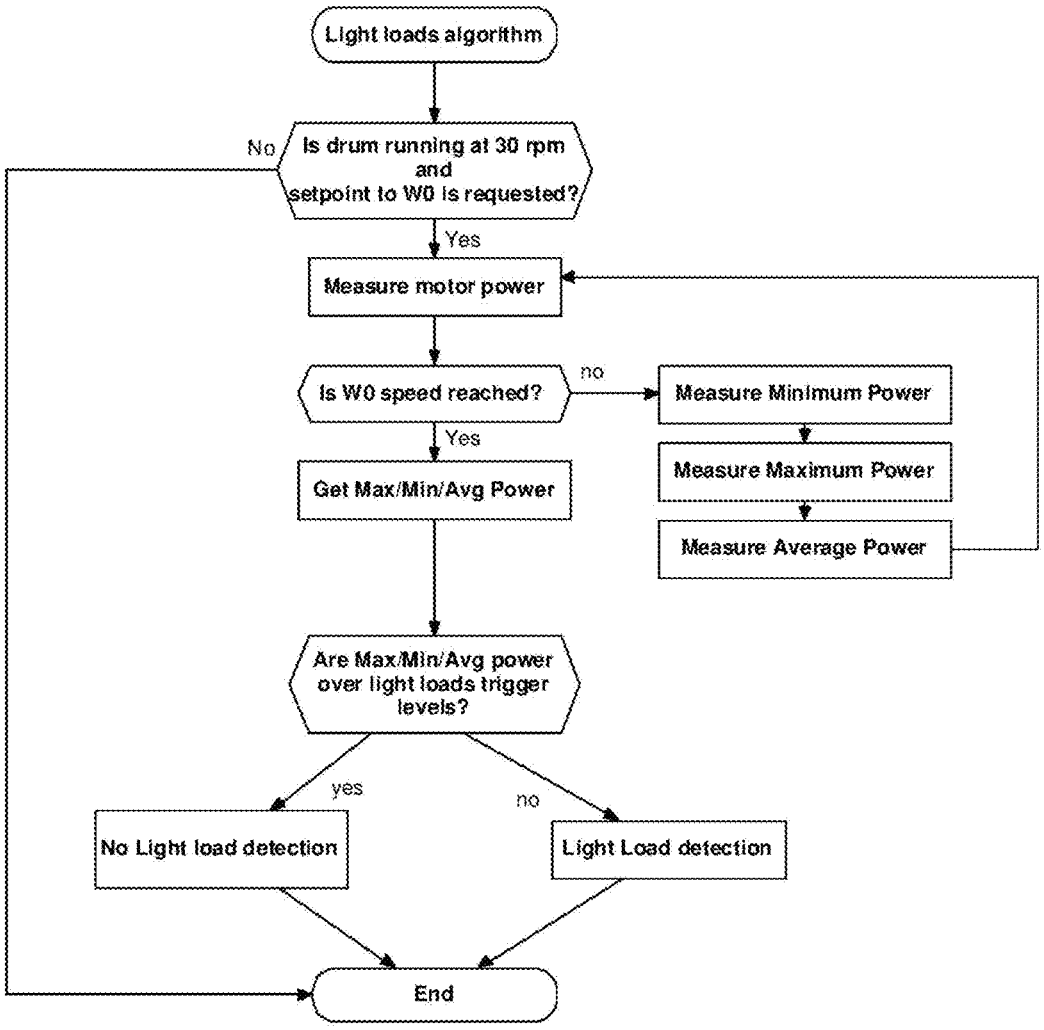

An advantageous algorithm is shown in FIG. 3. This algorithm is based on a washing process with an unknown quantity of laundry 30 in the drum 14. The rotational speed of the drum 14 is set to 30 rpm, and a set point W0 of 80 rpm is requested. If this is the case, the motor power is measured, in particular the current provided by the power control 32 to the drive motor 16 to effect this power. This current is directly monitored by current sensor 35 connected to the washing machine control 34. Furthermore, the rotational speed of the drive motor 16 is monitored, for example by an aforementioned incremental encoder. As long as during this speeding up starting from 30 rpm the setpoint rotational speed W0 has not been reached, the minimum power or current, the maximum power or current and the average power or current are measured. This measurement takes place as long as the rotational speed is increasing from the first low rotational speed, for example 30 rpm, to the second high rotational speed W0. As soon as this second high rotational speed is reached, average values are determined by the washing machine control 34 for the measured values of minimum power or current, maximum power or current and average power or current. So, an intermediate result has been achieved by producing these three averaged values.

In a next step, a comparison is made whether these three values for minimum, maximum and average power or current have exceeded trigger levels for these values. These values characterise the process in the case that a light load of the drum 14 is given, which means that a small quantity of laundry 30 corresponding to less than 15% of a nominal load weight of laundry is present in the drum 14. This means that if the nominal load weight of laundry for the washing machine 11 is 7 kg, the trigger level for a light load is 1.05 kg or less. This shows that the light load or small quantity really is small when compared to the nominal load. A large quantity could then be defined as more than 40% of this nominal load corresponding to more than 2.8 kg laundry, which is almost half the load. It should be borne in mind that this nominal load is not only a value for an optimized washing process, but can be regarded as a kind of maximum load which should not be exceeded, neither in weight nor in volume of laundry. If the load in the drum 14 is too heavy, for example because only jeans trousers are washed, this results in too much strain on the mechanical construction of the washing machine, in particular of the drum 14 and its rotation bearings. If such jeans trousers are soaked with water, they can become very heavy in comparison to their original volume in the dry state. If too much light laundry is stuffed inside the drum 14 resulting in the overall weight being lower than the nominal load, but the laundry as a whole cannot move relative to each other, the result of the washing process would also not be satisfying.

If all three values, in particular as their average, are found to be over the trigger levels for the light loads, then the result is definitive that the load of laundry 30 in the drum 14 is more than a light load. In consequence, a light load cannot be definitely detected or determined, respectively. This will end this process with the detection or finding that laundry with a weight exceeding a light load is present in the drum 14. Then a following washing program is adapted accordingly. This washing program follows the end of the process shown in FIG. 3.

In case that at least one of these values is lower than the trigger level for a light load, this means that no load larger than a light load is securely recognized. As a result, a case of a light load of laundry in the drum 14 is determined, and this information is then used in a subsequent washing process. This can be for example by reducing the amount of water used in the process, using less detergent and potentially shortening a dry-spinning phase of the laundry.

Similar as shown in FIG. 3 it can be provided for determining the case of a light load with higher accuracy that the default is that no light load is present. In this case, only if all three values for minimum, maximum and average power or current would be under the light load's trigger levels, the light load detection is regarded as positively certified. This means, compared to the aforementioned scenario, that a case of a light load detection is more difficult to be determined, but also with higher accuracy. If in this case only one value would not be under the light load's trigger level set in the washing machine control 34 or its storage 37, respectively, the case of a light load cannot be determined securely. In consequence, the washing machine would assume a regular load, for example corresponding to the third group with a quantity of laundry in the drum between a small quantity or light load, respectively, and a large quantity.

In a further similar manner, this determination of a case of no light load can be followed by a corresponding determination whether a large quantity or large load is present in the drum. Then another set of large load trigger levels is stored in the washing machine control 34, and the average values of the measured values for minimum, maximum and average power or current are compared to such large load trigger levels. Then again a default can either be set to be such a large load, and only if all three values would be under such a large load trigger level, the second group with a quantity of laundry in between small and large is determined. In this case, if only one value is above a large load trigger level, this large load or more than 40% of a nominal load is determined to be present for subsequent adaptation of a washing process.

In another case, it can be pre-defined that the default is a large load corresponding to the third group. Only if one value for power or current is under the large load trigger level, this large load is not detected resulting in the determination of a load of laundry in the drum 14 to be between a light load and a large load.

In any case, after this algorithm of FIG. 3 has been performed, a subsequent washing process for this laundry in the drum 14 of the washing machine 11 can be adapted to either one of the three groups of load or quantity of laundry 30 in the drum 14.

Figure 4:
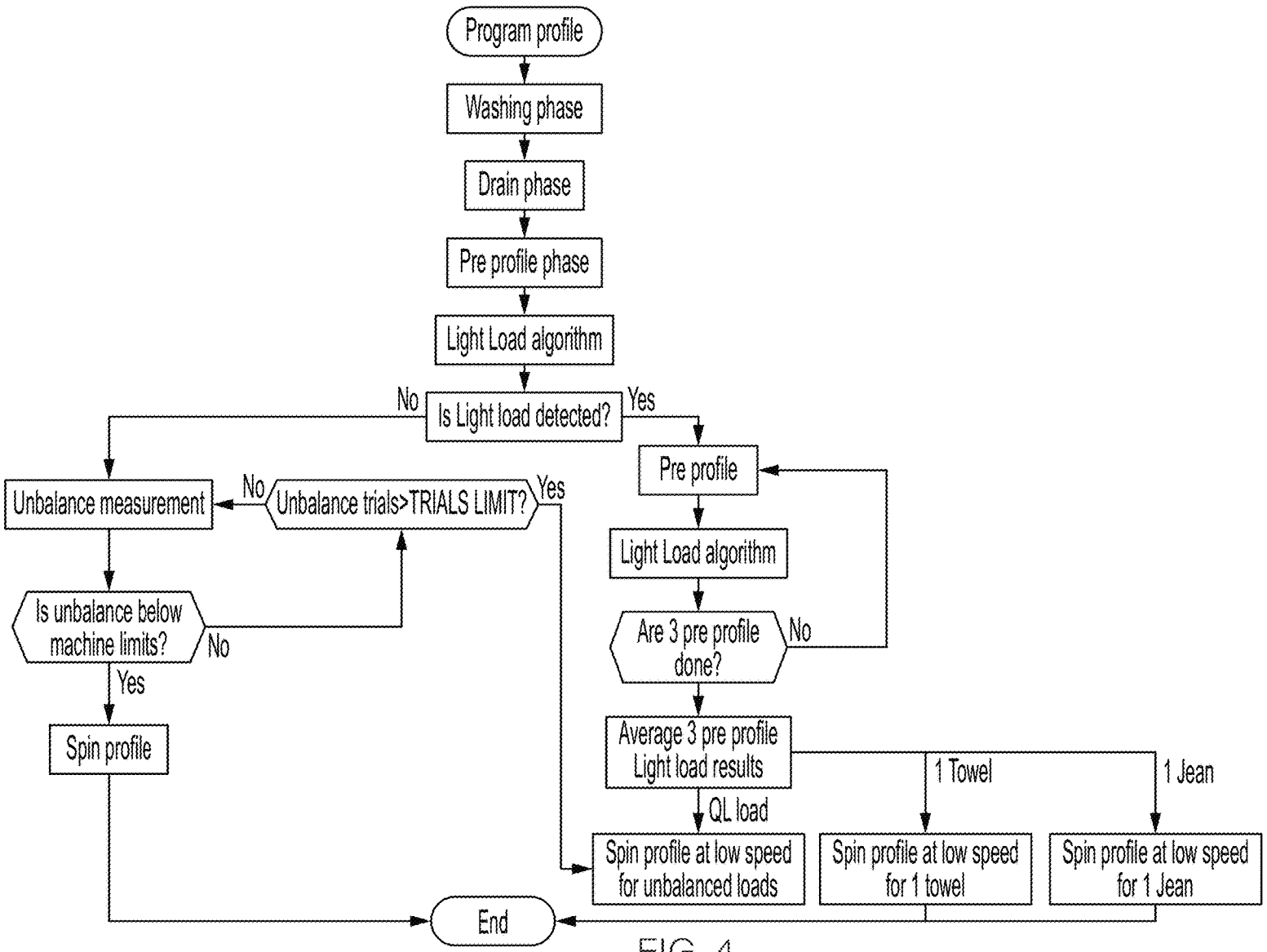
Figure 5:
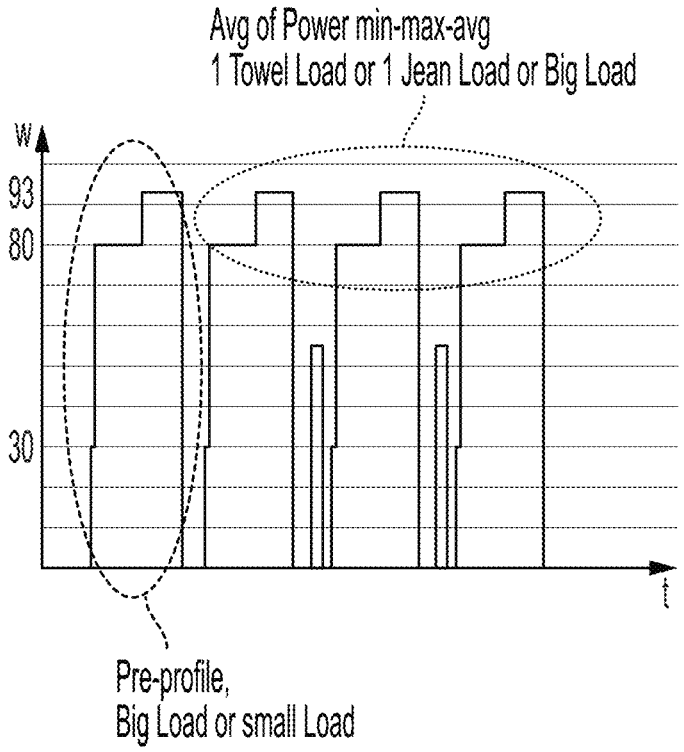
FIG. 5 shows the course of the rotational speed over time for use, FIG. 6 table for values or trigger levels for the powers, and FIG. 7 a table for various trigger levels.

In FIG. 4, another application of the method according to the invention is shown, which is used only for the dry-spinning phase in a washing process. This shows that in a certain program chosen for a certain quantity of laundry in the washing machine 11, the washing phase and then the drain phase are performed. Then a so-called pre-profile phase is performed, which is shown with its rotational speed w over time t in FIG. 5. In this pre-profile phase, the rotational speed is increased from 0 to first 80 rpm and then after a short time of only a few seconds up to 93 rpm. This serves to detect in a first step what current values are to be measured in the drive motor 16 or the current sensor 35, respectively. This pre-profile can already correspond to the light load's algorithm of FIG. 3. It allows for finding out whether a light load can be detected, whether a large load can be detected or whether a load in between can be detected.

After the pre-profile phase, the light load algorithm according to FIG. 3 is performed. In case no light load has definitely been detected, a potential unbalance is measured to get important information for a subsequent dry-spinning process. If it is found that the unbalance is below pre-defined threshold limits for the washing machine 11, the dry-spinning process with a defined spin profile is performed until its end. Then, the user can remove the laundry from the washing machine 11. If the unbalance is found to be not below pre-defined threshold limits for the washing machine 11, another trial for the unbalance measurement is made for a certain number of times. If this certain number is exceeded, for example 5 times or 10 times reaching a TRIALS LIMIT, it is determined that the unbalance is present and cannot be removed or avoided. This results in a spin profile for the dry-spinning process using only a low speed for such an unbalance load. This will result in the laundry containing more water than basically wished for in the end, which but cannot be avoided for not to damage the washing machine 11 mechanically.

If in the other case a light load has been detected in FIG. 4, the pre-profile is repeated once more followed by performing the light load algorithm once more. This is repeated for three times, and after that three light load results for values of power or current, respectively, have been produced and are available. The average of these is formed for comparing two trigger levels for light loads, potentially also two trigger levels for large loads. In case a large load corresponding to the aforementioned third group or more than 40% of a nominal load weight of laundry the drum has been determined, a case of a large quantity or QL load is defined resulting in using the aforementioned spin profile at low speeds. Even if this is not due to an unbalance in the drum 14, it is due to the relatively large load that a low speed is used.

If the average values show after comparison with values stored in the washing machine control 34 or its storage 37, respectively, that not only a light load is present but that this can be defined to be a towel or one towel only, respectively, a spin profile specifically designed for such a light load of only one towel is used for dry-spinning. If, however, the values show more correspondence to stored values corresponding to one single jeans trouser as laundry in the drum 14, a spin profile specifically adapted to this case is used for the dry-spinning.

The method according to the invention thus allows for better adapting specifically a spin profile or, more generally, other sequences of a washing process to the quantity of load of laundry in the drum. This may potentially also depend on the specific kind of laundry.

As has been mentioned before, FIG. 5 shows the course of the rotational speed w over time t for use in the pre-profile phase as well as in the light load algorithm phase. As can be seen, at a specific point of time, the drum is started to be accelerated by the drive motor 16 with a very short stop or continuous rotational speed at 30 rpm. Then the rotational speed is increased once more to 80 rpm, which means that during this increase from 30 rpm to 80 rpm, the aforementioned values for current corresponding to power or energy, respectively, arc measured. If the rotational speed of 80 rpm has been reached, this speed is kept for some seconds, for example 10 to 20 seconds. Then the speed is increased once more to 93 rpm, which again is held for some seconds, for example 10 to 20 seconds. The values for the current are not measured during this second speed increase up to 93 rpm.

This pre-profile according to the process of FIG. 4 can already correspond to the light load's algorithm of FIG. 3. It allows for finding out whether a light load can be detected whether a large load can be detected or whether a load in between can be detected.

After this first ramp, a second very similar or identical ramp is used for driving the drive motor 16. This ramp is repeated for two times, wherein in between two such ramps a short-time increase of rotational speed from 0 to about 55 rpm is made. After this, the drum is stopped again before performing the next ramp. This serves to mix and distribute the pieces of laundry inside the drum 14 corresponding to a usual process to try to remove a potential unbalance in the drum. After the third and last ramp in this profile, which corresponds to the fourth ramp in total, the process of detection according to FIG. 4 is finished. The washing machine control 34 can now adapt a following dry-spinning process to the quantity and to the type of laundry in the drum. This group of three ramps serves to try to differentiate between certain types of laundry, for example a towel or a jeans trouser as described before.

An example for values or trigger levels for the power, which of course directly corresponds to the current measured by the current sensor 35, are given in FIG. 6 in a table. The first category is a light load being made up of only one towel. It can be seen that the values of minimum power, maximum power and average power differ. They are again divided into a minimum value for the minimum power, a maximum value for the minimum power and an average value for the minimum power. The same is given for values for the maximum power and the average power. In consequence, FIG. 6 can be a table stored in the storage 37 of the washing machine control 34, which can be used to compare measured and determined values for power processed by the pre-profile and the average three trials according to FIG. 5 or the light load's algorithm according to FIG. 3, generally. It can also be seen that each set of average values for minimum power, maximum power and average power is specific. For the light load being made up of only one single jeans trouser, these three values are in each case much lower than for the other cases, in particular when compared to the third case with the large load.

The profiles or ramps for the pre-profile as well as for the following three trials should be held very accurately to definitely have the same conditions as when these values have been produced and stored for processing the table of FIG. 6.

When comparing the values for one towel against those of a large quantity, it is remarkable that the values for the maximum power are not so different, in particular when looking at the pre-profile. A definite distinction can be made for example with the average values for the minimum power, where they clearly differ.

In FIG. 7, a table is given for trigger levels for minimum power. This can be 32 for a large load QL, 17 for one single towel and 7 for one single jeans trouser. For maximum power and for average power, further values are given.

The invention claimed is:

1. A method of operating a washing machine, said washing machine comprising:

a drum for holding laundry, said drum being rotatable, a drive motor for said drum, a power supply for controlling said drive motor, a washing machine control, said washing machine control being connected to said power supply, said washing machine control being designed to monitor and measure or evaluate, together with said power supply, a current curve when said drive motor is driven with power, a receiving container for receiving said drum therein, said method having the following steps:

said drum is rotated at a first low rotational speed, a current through said drive motor and a rotational speed of said drive motor are monitored and measured, said rotational speed of said drum is increased to a second high rotational speed, second high rotational speed being higher than said first low rotational speed, said current curve during said increase of said rotational speed from said first low rotational speed to said second high rotational speed is measured and values for a current minimum, a current maximum and an average current are measured, wherein average values are being determined from said values, said determined average values for said current minimum, said current maximum and said average current are compared with memory values for said current minimum, said current maximum and said average current, said memory values being stored in said washing machine control in a table, wherein said memory values are stored in said table with division into at least three groups, a first said group being a small quantity defined as less than 15% of a nominal load weight of laundry in said drum, a second said group being a large quantity defined as more than 40% of a nominal load weight of laundry in said drum, and a third said group being a quantity of laundry in said drum which lies between said small quantity and said large quantity, in a comparison of said average values with said memory values, a greatest possible concordance is determined in each case between said values for at least two said values, and then said group corresponding to said memory values with said corresponding quantity of said laundry is defined as being present in said drum.

2. The method according to claim 1, wherein said first low rotational speed is between 10 rpm and 50 rpm.

3. The method according to claim 1, wherein said second high rotational speed is between 55 rpm and 150 rpm.

4. The method according to claim 1, wherein a certain group with quantity of laundry in said drum is considered to be recognized only if all three said average values for said current minimum, said current maximum and said average current fit to the same group or correspond to said memory values of said group.

5. The method according to claim 1, wherein in a previous step it is determined by monitoring said current through said drive motor whether there is said small quantity defined as less than 15% of a nominal load weight of laundry in said drum or said large quantity defined as more than 40% of a nominal load weight of laundry in said drum and, if said large quantity of laundry is detected, subsequently another operation for treating said laundry is carried out.

6. The method according to claim 5, wherein said other operation for treating said laundry subsequently is carried out with different parameters selected from a group of rotational speed, water supply, detergent supply.

7. The method according to claim 1, wherein said increasing of said rotational speed from said first low rotational speed to said second high rotational speed is carried out three times and said average values for said current minimum, said current maximum and said average current are determined therefrom in total.

8. The method according to claim 1, wherein, in said table stored in said washing machine control, a distinction is made not only according to said quantity of laundry, but additionally also according to said type of laundry present in said drum, different memory values for said minimum current, said maximum current and said average current also being stored for said purpose in each said group, a quantity of laundry and a type of laundry in said drum being determined by comparison of said average values for said minimum current, said maximum current and said average current.

9. The method according to claim 1, wherein a group corresponding to said memory values with said corresponding quantity of laundry is defined as being present in said drum for a further subsequent washing or spinning process.

10. Washing machine comprising:

a drum for holding laundry, said drum being rotatable, a drive motor for said drum, a power supply for controlling said drive motor, a washing machine control being connected to said power supply, and being designed to monitor and measure, together with said power supply, a current curve when said drive motor is driven with power, a receiving container for receiving said drum therein, wherein said washing machine control is adapted and designed to operate said washing machine with the method according to claim 1.

* * * * *